United States Patent [19]

Andrews

[11] Patent Number: 4,709,648

[45] Date of Patent: Dec. 1, 1987

[54] BOAT SEAT BRACKET

[75] Inventor: John R. Andrews, Jackson, Miss.

[73] Assignee: Cullen Wayne Fugitt, Terry, Miss. ; a part interest

[21] Appl. No.: 894,833

[22] Filed: Aug. 8, 1986

[51] Int. Cl.[4] ..... B63B 17/00

[52] U.S. Cl. ..... 114/363

[58] Field of Search ..... 114/363; 248/226.1, 248/287, 430; 297/252, 314

[56] References Cited

U.S. PATENT DOCUMENTS

| | | | |
|---|---|---|---|
| 3,179,961 | 4/1965 | Ward et al. | 114/363 |
| 3,519,240 | 7/1970 | Swenson | 248/399 |
| 3,692,270 | 9/1972 | McAuliffe | 248/384 |
| 3,718,365 | 2/1973 | Gibson | 114/363 |
| 4,432,525 | 2/1984 | Duvall | 114/363 |
| 4,566,734 | 1/1986 | Bruner | 297/346 |

*Primary Examiner*—Joseph F. Peters, Jr.
*Assistant Examiner*—Jesûs D. Sotelo
*Attorney, Agent, or Firm*—Fleit, Jacobson, Cohn & Price

[57] ABSTRACT

A seat assembly is provided for an elongated horizontal transverse bench seat of a fishing boat and is mounted from the bench seat for shifting therealong substantially the full length of the bench seat and for swinging relative to the bench seat between an operative position overlying and supported from the bench seat and an inoperative position swung upwardly away from, outwardly from one side of the bench seat and then downwardly toward the associated boat bottom.

11 Claims, 7 Drawing Figures

BOAT SEAT BRACKET

BACKGROUND OF THE INVENTION

1. Field of the Invention

This invention relates to a seat assembly mounted upon a transverse bench-type seat of a fishing boat or the like extending between the opposite sides of the fishing boat and with the seat assembly slidably mounted from the bench seat for displacement longitudinally therealong back and forth between the boat's sides and also for pivotal displacement relative to the bench seat about an axis disposed outwardly of and extending along one longitudinal side margin of the bench seat.

2. Description of Related Art

Various different forms of seat assemblies heretofore have been provided for use on elongated bench seats extending transversely between the opposite sides of a fishing boat. These previously known forms of seat assemblies have been mounted relative to the associated bench seat in various different ways. Examples of seat mounting structures including some of the general structural and operational features of the instant invention are disclosed in U.S. Pat. Nos. 3,179,961, 3,519,240, 3,692,270, 3,820,784, 3,969,620 and 4,566,734. However, these previously known forms of seats and seat mounting structures do not include the combination of structural features of the instant invention which provides a seat that may not only be swung to a retracted position, but which may also be shifted lengthwise of the associated bench seat between the opposite sides of the corresponding fishing boat.

SUMMARY OF THE INVENTION

The seat assembly of the instant invention includes an arm-type mount having one end slidably and pivotally supported from a boat transverse bench seat for guided movement longitudinally of one longitudinal marginal edge of the bench seat and for swinging of the mount about an axis spaced outwardly of an extending along the bench seat one marginal edge with the mount being swingable from a first horizontal position overlying and abutting the upper surface of the bench seat and a second position swung outwardly and downwardly toward a vertical position along the seat one marginal portion. The arm mount, when in the horizontal position, includes an upwardly facing seat cushion supported therefrom through the utilization of a lazy susan swivel and a backrest portion projecting upwardly from one marginal edge of the seat portion and swingably foldable downwardly into a horizontal position closely overlying the seat cushion.

The main object of this invention is to provide a boat seat assembly mounted upon a transverse bench-type boat seat for movement of the seat assembly longitudinally along the transverse seat, whereby the seat assembly may be disposed transverse amidships or adjacent either side of the boat.

Another object of this invention is to provide a seat assembly pivotally mounted from a boat transverse bench seat in a manner such that the seat assembly may be swung from a horizontal position to a vertical position extending along one marginal edge of the transverse boat seat below the upper surface of the boat seat.

Still another object of this invention is to provide a seat assembly incorporating a rotatably mounted seat cushion.

An ancillary object of this invention is to provide a seat assembly in accordance with the preceding object and including a foldable backrest portion.

A further object of this invention is to provide a seat assembly constructed in a manner facilitating ready removal of the seat assembly from an associated transverse bench seat.

A final object of this invention to be specifically enumerated herein is to provide a seat assembly in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
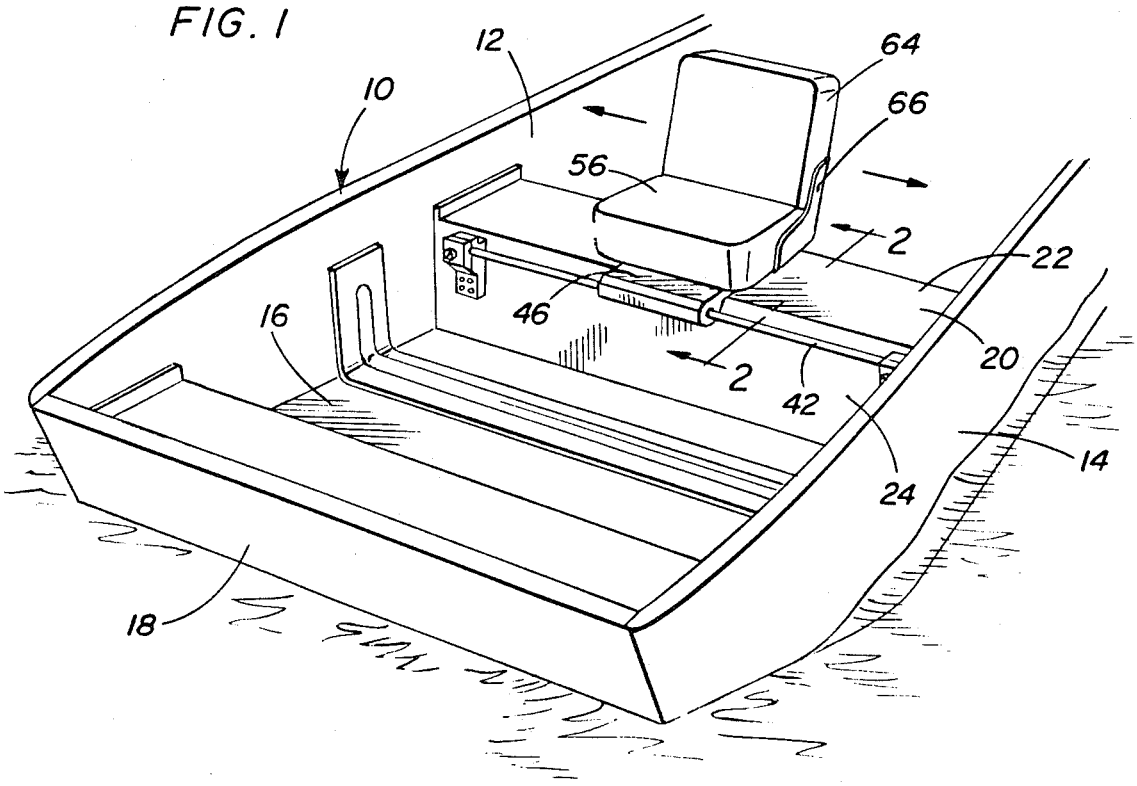
FIG. 1 is a fragmentary perspective view of a typical lightweight fishing boat with the seat assembly of the instant invention operatively associated with one of the transverse bench-type seats of the fishing boat.

Referring now more specifically to the drawings, the numeral 10 generally designates a lightweight fishing boat including opposite sides 12 and 14 between which a bottom 16 extends and closed at its forward end by a bow section 18. The boat 10 represents a conventional form of light-weight fishing boat and incorporates at least one elongated, horizontal and transverse bench-type seat 20 extending between the sides 12 and 14. The seat 20 includes a top panel 22 and front and rear side panels 24 and 26. In some instances, the side panels 24 and 26 and the top panel 22 are integrally formed and the seat 20 actually comprises an inverted generally U-shaped structure extending and secured between the sides 12 and 14 above the bottom 16. Additionally, if the bench seat 20 is in the form above described, the interior thereof may be filled with any suitable form of lightweight floatation (not shown).

The seat assembly of the instant invention is referred to in general by the reference numeral 30 and includes a pair of mounting brackets 32 secured to opposite ends of the front side panel 24 through the utilization of suitable fasteners 34. The mounting brackets 32 incorporate cap plates 36 removably secured in position through the utilization of removable fasteners 38 and the cap plates 36 and mounting brackets 32 together define opposing cylindrical recesses 40 in which the opposite ends of a combined support and pivot rod 42 are removably received.

One end 44 of a mounting arm or arm mount 46 has a transverse bore 48 formed therethrough and the rod 42 is slidably and rotatably received through the bore 48. Accordingly, the mounting arm 46 may be shifted longitudinally of the rod 42 and also angularly displaced about the latter between the horizontal position thereof illustrated in FIG. 2 with the arm 46 overlying and abutting the top panel 22 of the seat 20 and a vertical position such as that illustrated in FIG. 4 with the mounting arm 46 depending downwardly from the rod 42 forward of the seat 20.

Figure 2:
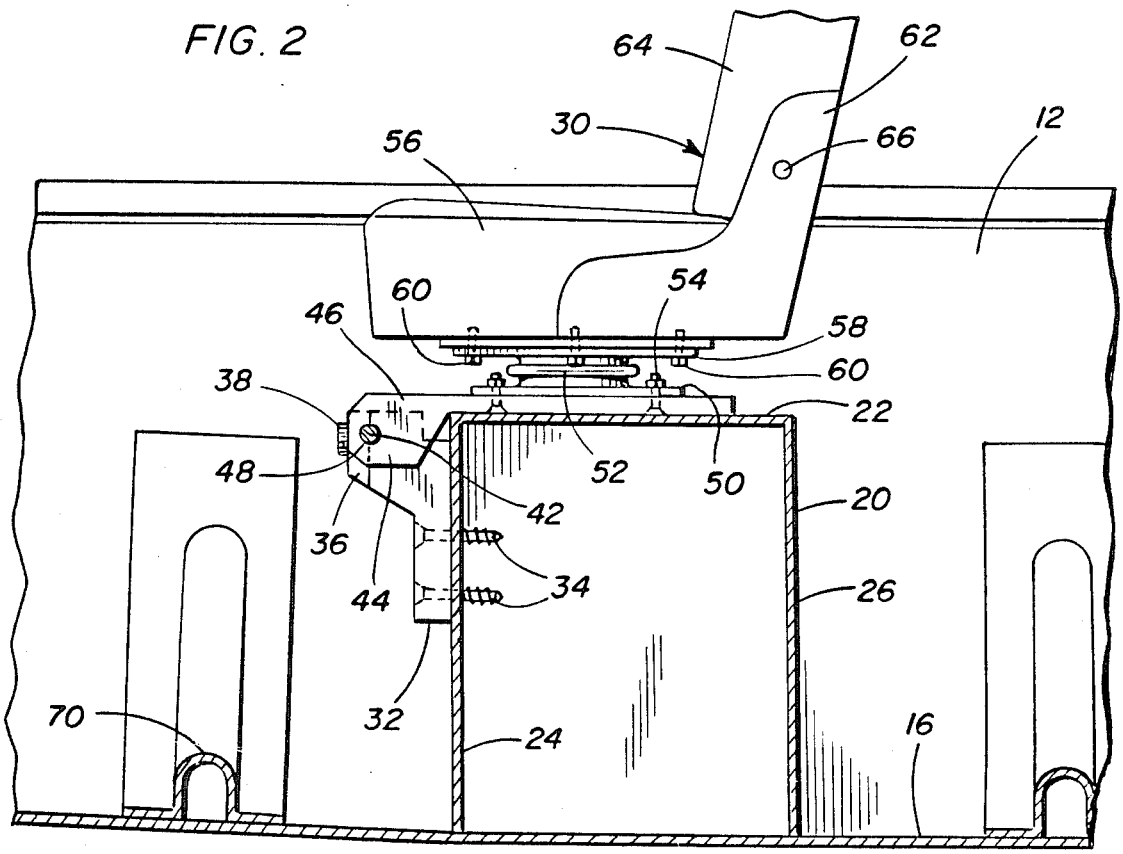
FIG. 2 is an enlarged fragmentary vertical sectional view taken substantially upon this place indicated by the section line 2—2 of FIG. 1.
Figure 3:
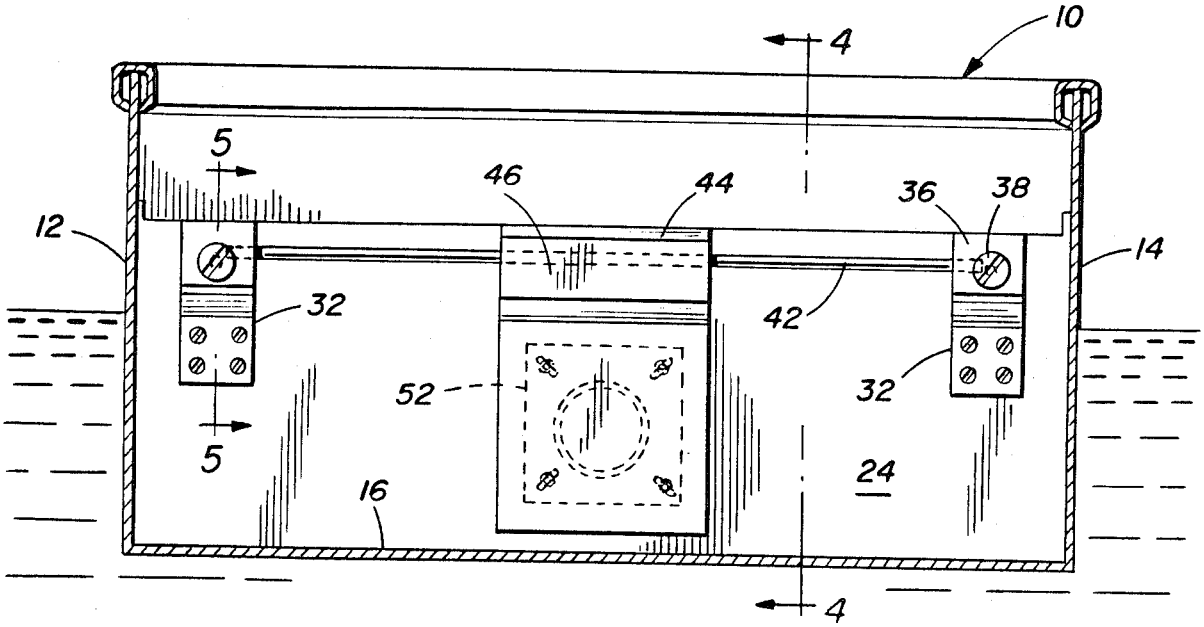
FIG. 3 is a transverse horizontal sectional view of the boat illustrating the arm mount of the instant invention in a forwardly and downwardly swung retracted position.

With attention now invited more specifically to FIG. 2 of the drawings, it may be seen that the lower mounting plate 50 of a lazy susan swivel 52 is anchored relative to the second end of the mounting arm 46 overlying the top panel 22 by suitable removable fasteners 54. Further, the seat assembly 30 includes a seat portion 56 to which the upper plate 58 of the swivel 52 is secured through the utilization of removable fasteners 60 and the seat assembly 30 includes opposite side brackets 62 mounted stationary relative to the seat portion 56 and from which a backrest portion 64 is pivotally mounted as at 66 for movement between an upright position such as that illustrated in FIG. 2 and a forwardly and downwardly swung generally horizontal position closely overlying the seat portion 56.

The fasteners 60 are readily removable and the seat assembly 30 is therefore removably supported from the upper plate 58.

Figure 4:
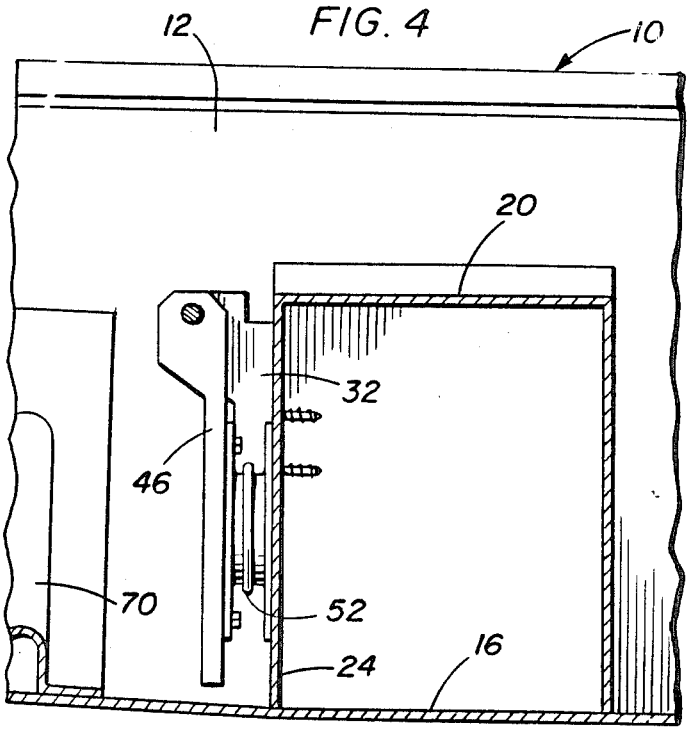
FIG. 4 is a fragmentary vertical sectional view taken substantially upon the plane indicated by the section line 4—4 of FIG. 3.
Figure 5:
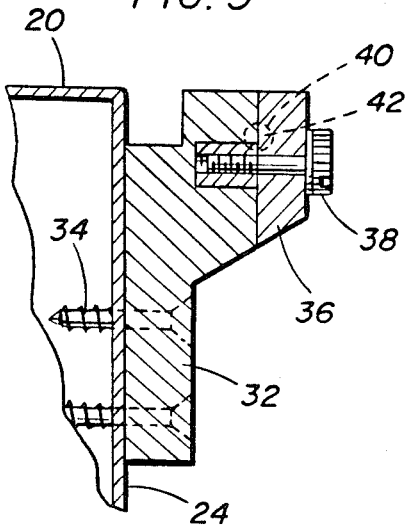
FIG. 5. is an enlarged fragmentary vertical sectional view taken substantially upon the plane indicated by the section 5—5 of FIG. 3.

Accordingly, although the seat assembly 30 may be shifted longitudinally along the rod 42 from one side of the boat to the other or positioned amidships and further may be swung forwardly relative to the seat 20 in order to expose the entire upper surface thereof defined by the top panel 22, if it is desired to swing the mounting arm 46 to the fully retracted position thereof illustrated in FIG. 4, the fasteners 60 are removed to thereby disengage the seat assembly 30 from the mounting arm 46. Thereafter, the mounting arm 46 may be swung to the fully retracted position thereof illustrated in FIG. 4 with the swivel 52 attached thereto.

Also, the seat back portion 64 may be pivoted relative to the brackets 62 toward position closely overlying and generally paralleling the seat portion 56. Then, the entire seat assembly and mounting arm 46 may be swung in a counterclockwise direction as viewed in FIG. 2 of the drawings approximatley 180°. In this position, the rear side of the backrest postion 64 will closely overlie the bottom 16 and abuttingly engage the transverse rib 70 of the boat 10 disposed forward of the bench seat 20. Accordingly, the seat assembly 30 may be swung fully from an operative position to a position with the entire upper surface of the top panel 22 fully exposed without removal of the seat assembly 30 from the swivel 52. Further, the seat assembly 30 also may be removed from the boat 10 by loosening one of the fasteners 38 and removing the other fastener 38 so as to release the clamp plates 36 and thereby allow the opposite ends of the rod 42 to be disengaged from the mounting brackets 32. Then, if it is desired, either the rod 42 and seat assembly 30 may be stored, or the rod 42 may be axially withdrawn from the bore 48 and reinstalled on the mounting brackets 32 to thus allow the seat assembly 30, including the mounting arm 46, to be stored in a remote location.

Figure 6:
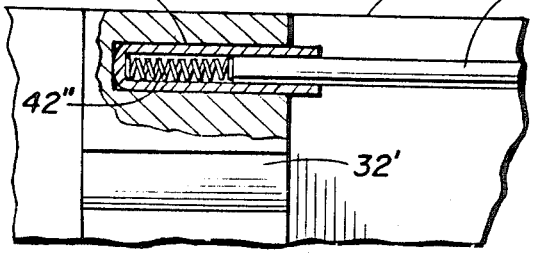
FIG. 6 is a fragmentary elevational view of a modified structure for removably mounting the slide and pivot bar of the seat assembly from boat bench seat mounted brackets.
Figure 7:
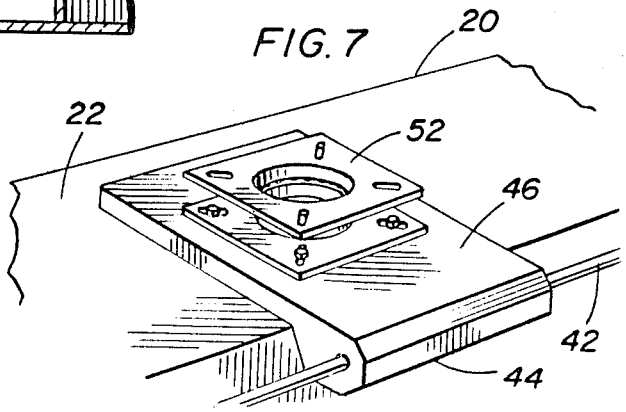
FIG. 7 is a fragmentary perspective view illustrating the seat assembly arm mount in an operative position, but with the seat removed from the mounting swivel thereof.

With intention now invited more specifically to FIG. 6 of the drawings, there may be seen a modified form of rod 42' used in conjunction with mounting bracets 32' which are of one piece construction but which define opposing cylindrical recesses 40'. The rod 42' includes spring biased opposite end tubular members 42'' telescoped thereover and receivable in the recesses 40'. The tubular members 42'' project slightly outwardly of the recesses 40' to allow the outwardly projecting end of one of the tubular members 42'' to manually grasped and axially withdrawn from the corresponding recess 40' while the rod 42' is axially biased into a fully seated position within the opposite tubular member 42'. Also, it is to be noted that other structures for removably mounting the rod 42 or the rod 42' from the brackets 32 and 32' may be used.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a boat of the type including opposite sides and an elongated bench seat extending lengthwise transversely of said boat at least substantially between said sides and including opposite side longitudinal margins, a seat assembly including a horizontal seat portion having front and rear marginal portions, said bench seat and seat assembly including coacting mounting means mounting said seat assembly from one of said margins with said seat assembly supported atop said bench seat for support therefrom and for guided sliding movement therealong throughout at least a major portion of the length of said bench seat, whereby said seat assembly may be guidingly shifted between positions adjacent the sides of said boat, said coacting means including pivot means swingably supporting said seat assembly from said one margin for angular displacement relative to said bench seat about an axis closely adjacent and paralleling said one margin and with said seat assembly being swingable generally 180° about said axis upwardly away from said bench salt, outwardly of said one margin and then downwardly to an inverted position disposed outwardly of said one margin and below the upper extremity of said bench seat, with an effective pivotal and sliding connection maintained between said seat assembly and said one margin throughout the swinging of said seat assembly relative to said bench seat as well as the sliding of said seat assembly relative to said bench seat.

2. The boat and seat assembly combination of claim 1 wherein said seat assembly includes backrest portion projecting upwardly from said rear marginal portion of said horizontal seat portion.

3. The combination of claim 1 wherein said coacting mounting means includes an elongated arm assembly having first and second end portions, said pivot means including means pivotally and slidably mounting one end portion of said arm assembly from said bench seat for angular displacement about and adjustable shifting along said axis, and support means mounting said seat assembly from the second end portion of said arm assembly.

4. The combination of claim 1 wherein said pivot means includes a support and pivot rod mounted from said bench seat and disposed slightly outwardly of said one longitudinal margin thereof, an elongated arm assembly including first and second end portions, said seat assembly being mounted on said second end portion, said arm assembly first end portion being rotatably and slidably mounted on said rod.

5. The combination of claim 4 including means removably supporting said rod from said bench seat.

6. The combination of claim 5 wherein said means removably supporting said rod from said bench seat includes mounting brackets carried by said bench seat and spaced along said one marginal portion and defining endwise outwardly opening recesses, said rod including spring biased end extension members carried by the opposite ends thereof and seated in said recesses.

7. The combination of claim 5 wherein said means removably supporting said rod from said bench seat includes opposite end mounting brackets carried by said one margin of said bench seat, said brackets including means removably clamp supporting the opposite ends of said rod from said brackets.

8. The combination of claim 5 wherein said support means includes a swivel assembly whereby said seat assembly is angularly displaceable relative to said arm assembly about an upstanding axis disposed generally normal to the first mentioned axis.

9. The combination of claim 8 wherein said seat assembly includes an upright backrest portion projecting upwardly from said rear marginal portion of said horizontal seat portion.

10. In combination with a boat of the type including opposite sides and an elongated bench seat extending lengthwise transversely of said boat at least substantially between said sides and including opposite side longitudinal margins, a seat assembly including a horizontal seat portion having front and rear marginal portions, said bench seat and seat assembly including coacting mounting means mounting said seat assembly from one of said margins with said seat assembly supported atop said bench seat for support therefrom and for guided movement therealong throughout at least a major portion of the length of said bench seat, whereby seat assembly may be guidingly shifted from one side of said boat to the other side thereof, said coacting mounting means including pivot means swingably supporting said seat assembly from said one margin for angular displacement relative to said bench seat about an axis closely adjacent and generally paralleling said one margin and with said seat assembly being swingable upwardly away from said bench seat, outwardly of said one margin and then downwardly to an inverted position disposed outwardly of said one margin and disposed below the upper extremity of said bench seat, said coacting mounting means also including an elongated arm assembly having first and second end portions, said pivot means including means pivotally and slidably mounting one end portion of said arm assembly from said bench seat for angular displacement about and adjustable shifting along said axis, support means mounting said seat assembly from the second end portion of said arm assembly, said support means including a swivel assembly whereby said seat assembly whereby said seat assembly is angularly displaceable relative to said arm assembly about an upstanding axis disposed generally normal to the first mentioned axis.

11. The combination of claim 10 wherein said seat assembly includes an upright backrest portion projecting upwardly from said rear marginal portion of said horizontal seal portion.

* * * * *